United States Patent [19]

Hornby

[11] 4,249,463

[45] Feb. 10, 1981

[54] WORKSTATION

[75] Inventor: Leonard Hornby, Atherton, England

[73] Assignee: Howorth Air Engineering Limited, Farnworth, England

[21] Appl. No.: 39,689

[22] Filed: May 16, 1979

[30] Foreign Application Priority Data

May 23, 1978 [GB] United Kingdom ..... 21534/78

[51] Int. Cl.[3] ..... F23J 11/00

[52] U.S. Cl. ..... 98/115 LH; 55/DIG. 18

[58] Field of Search ..... 98/115 R, 115 LH, 36; 55/DIG. 18, DIG. 29; 362/373

[56] References Cited

U.S. PATENT DOCUMENTS

| | | | |
|---|---|---|---|
| 3,301,167 | 1/1967 | Howard et al. | 98/115 LH |
| 3,811,250 | 5/1974 | Fowler, Jr. | 98/115 LH X |
| 4,039,817 | 8/1977 | Williams | 362/373 |
| 4,100,847 | 7/1978 | Norton | 98/115 LH |

*Primary Examiner*—Albert J. Makay
*Assistant Examiner*—Harold Joyce
*Attorney, Agent, or Firm*—Ross, Ross & Flavin

[57] ABSTRACT

A workstation (10) includes a working area (12) inside an enclosure (11) to which an operative can gain access via an access aperture (13) beneath a transparent window, an air circulation system, including a fan (16), being provided for drawing air from the enclosure (11) and directing it back to the enclosure (11) via a filter (15), an outlet being provided downstream of the filter for diverting a proportion of the clean air from the filter (15), so as to cause a lowering of pressure inside the enclosure (11) sufficient to cause an inflow of ambient air via the access aperture (13). The outlet is connected to the atmosphere via a secondary fan (32) which is actuate by a contamination sensor (34).

1 Claim, 2 Drawing Figures

WORKSTATION

DESCRIPTION

Figure 1:
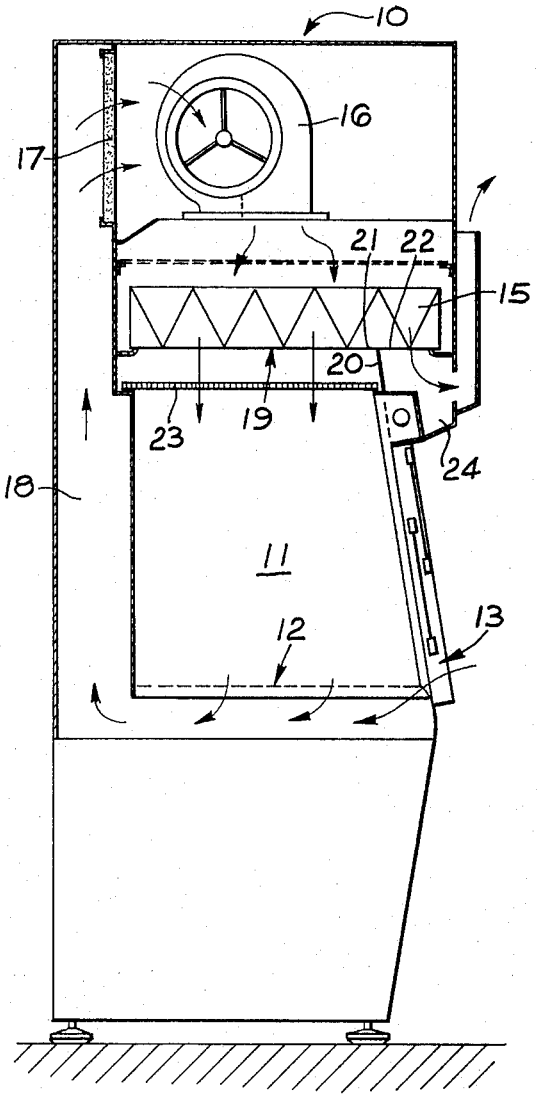

This invention relates to a workstation suitable for use in handling materials which are potentially dangerous (such as biological substances and radiopharmaceuticals) and from which operators and the atmosphere must be protected.

Such workstations usually have a perforated working surface in an enclosure to which an operator can gain access, by his hands and forearms, through an access aperture, clean air being supplied to the enclosure through a HEPA (or equivalent) filter and withdrawn via the perforated surface. Normally, the arrangement of the air supply is such as to cause an inward flow of ambient air via the access aperture to prevent egress of material from the enclosure. Provision is often made for modification of the air flow to cause a greatly increased inflow of air at the access aperture in the event of spillage so as to reduce to a very low level chance of escape of material from the enclosure. This greatly increased flow of air is then passed through a second filter before being discharged to atmosphere. A known such workstation having all these facilities has two fans, a total of three filters, a considerable amount of ducting, and a plurality of flow control flaps. This naturally makes it very expensive.

An object of the invention is to provide an improved workstation which is suitable for use in handling potentially dangerous material and which is simple in construction.

Accordingly the invention provides a workstation including a working surface inside an enclosure, the enclosure being bounded by at least one transparent window beneath which is an access aperture via which an operative can gain access to the working surface, an air circulation system being provided, including a fan, for drawing air from the enclosure and directing it back to the enclosure via a filter, an outlet being provided down stream of the filter for diverting a proportion of the clean air from the filter, so as to cause a lowering of pressure inside the enclosure sufficient to cause an inflow of ambient air via the access aperture.

Preferably the outlet is immediately downstream of the filter, which can be a HEPA or equivalent filter.

The outlet can be formed by dividing the downstream face of the filter by a baffle into a larger area whence air passes to the enclosure and a smaller area whence air passes to a duct leading to atmosphere.

It will be appreciated that this construction of workstation uses only one filter, but still ensures that there is an inward flow at the access aperture and that the air expelled to atmosphere is clean.

When it is desired to provide for a high volume flow inwards via the access aperture, in case of spillage, the outlet can be connected to atmosphere via a powerful secondary fan, effective to draw a substantially proportion of the air from the one fan through the filter to cause a substantial pressure drop in the enclosure to encourage a high inward flow through the access aperture. Again, only a single filter is used and the air discharged to atmosphere is clean.

The air will conveniently be drawn from the enclosure via perforations in the working surface, passing through a pre-filter before it reaches the fan.

Figure 2:
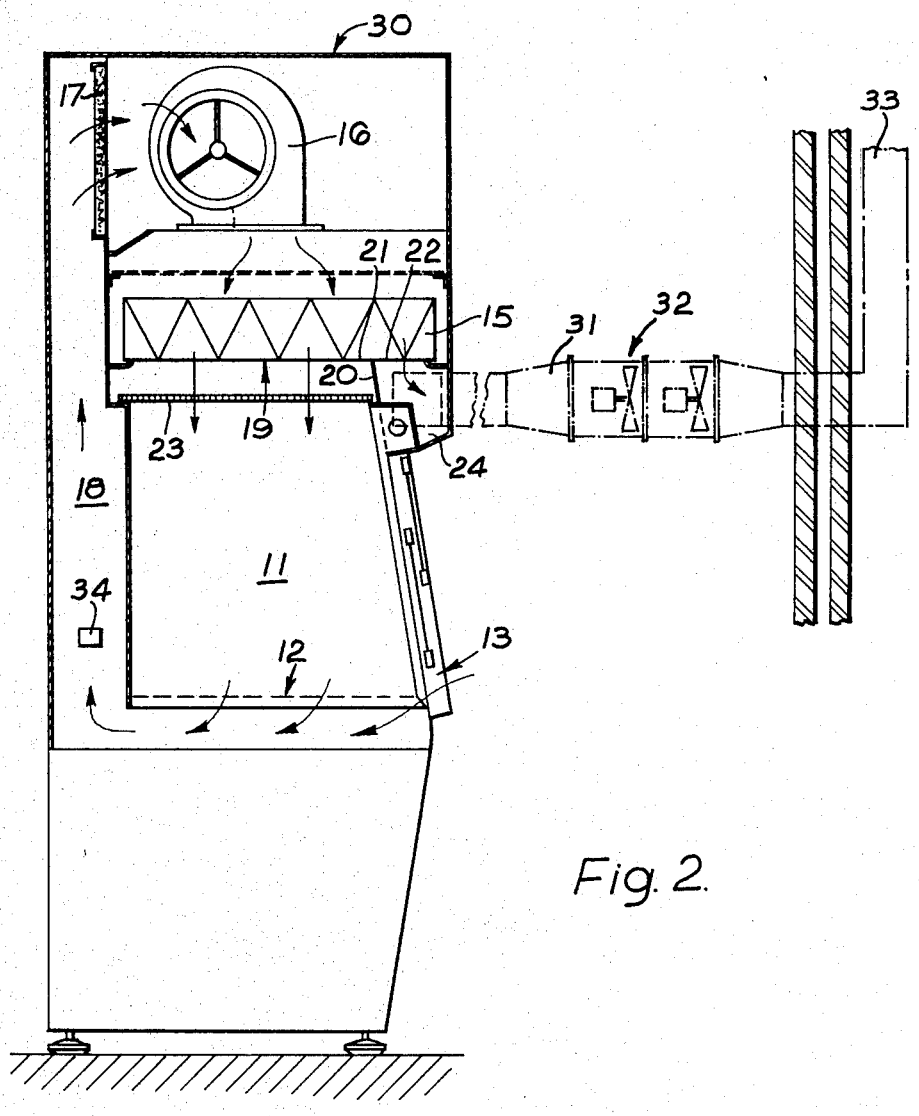

The invention will be described further, by way of example, with reference to the accompanying drawings, wherein:

FIG. 1 is a cross-sectional elevation of a first embodiment of workstation of the invention; and FIG. 2 is a similar view of the second embodiment of workstation.

A first preferred embodiment of workstation 10 of the invention has an enclosure 11 above a perforated working surface 12 adjacent which there is an access aperture 13 beneath a transparent window. An air circulating system of the apparatus 10 includes a filter 15 above the enclosure 11 and a fan 16, having a pre-filter 17, above the filter 15. A duct 18 leads from beneath the working surface 12 to the pre-filter 17. The lower surface 19 of the filter 15 is divided by a baffle 20 into a larger area 21 and a smaller area 22. Air leaving the smaller area 22 passes into a chamber 24 and thence via an outlet 25 to atmosphere. The ratio of the areas 21 and 22 is so chosen that of the air passing through the filter 15 some 10% to 25% is passed to atmosphere.

The result of providing the outlet 25 is that a lowered pressure exists in the enclosure 11, by allowing a percentage of clean air to be drawn in through the opening 13 and thereby containing the potentially dangerous material within the workstation.

A second embodiment of workstation 30 of the invention is suitable for use with materials such as radiopharmaceuticals wherein if a spillage occurs a rapid flushing with ambient air is desirable. The workstation 30 is very similar to workstation 10 and the only major modification is the connection of chamber 24 to ducting 31 leading via a powerful fan assembly 32 to an external outlet 33. A geiger counter sensor head 34 can be mounted in duct 18 to sense any radio-activity in duct 18 due to spillage. If spillage does occur, the sensor 34 causes the powerful fan assembly 32 to operate, drawing a substantial part (say 80% to 90%) of the output of fan 16 via area 22, chamber 24 and the ducting 31 to atmosphere. This causes a corresponding greatly increased flushing air stream to enter via aperture 13.

Again it will be appreciated that the workstation 30 uses only one filter, does not have any movable flow control flaps, and the normal fan 16 does not have to be switched off or its flow modified. Again the air exhausted to atmosphere is clean.

I claim:

1. A workstation including: an enclosure, a working surface inside the enclosure, the enclosure being bounded by at least one transparent window beneath which is an access aperture via which an operator can gain access to the working surface, an air circulation system including a filter and a fan for drawing air from the enclosure and directing it back to the enclosure via the filter, an outlet downstream of the filter for diverting a proportion of the clean air from the filter for causing a lowering of the pressure inside the enclosure sufficient to cause an inflow of ambient air via the access aperture, the outlet being immediately downstream of the filter and formed by dividing a downstream face of the filter by a baffle into a larger area whence air can pass to the enclosure and a smaller area whence air can pass to a duct leading to atmosphere, the outlet being connected to atmosphere via a secondary fan effective upon operation to draw a substantial proportion of the air from the fan of the air circulation system through the smaller area of the filter, the secondary fan being actuable in response to a contamination sensor in a duct leading from the working surface to the first fan.

* * * * *